United States Patent [19]

Fröhlich et al.

[11] 4,334,556

[45] Jun. 15, 1982

[54] WOVEN SLIDE FASTENER STRINGER

[75] Inventors: Alfons Fröhlich; Karl Griessbaum, both of Essen, Fed. Rep. of Germany

[73] Assignee: Opti Patent-, Forschungs- und Fabrikations-AG, Riedern-Allmeind, Switzerland

[21] Appl. No.: 33,224

[22] Filed: Apr. 25, 1979

[30] Foreign Application Priority Data

Apr. 27, 1978 [DE] Fed. Rep. of Germany ..... 2818508
Apr. 27, 1978 [DE] Fed. Rep. of Germany ..... 2818509
Apr. 27, 1978 [DE] Fed. Rep. of Germany ..... 2818838

[51] Int. Cl.[3] ..... D03D 1/00
[52] U.S. Cl. ..... 139/384 B; 24/205.16 C
[58] Field of Search ..... 139/11, 384 B, 116; 24/205.13 C, 205.16 C

[56] References Cited

U.S. PATENT DOCUMENTS 3,807,462 4/1974 Nogai ..... 139/384 B
3,847,188 11/1974 Auer et al. ..... 139/384 B
3,880,203 4/1975 Fröhlich ..... 139/384 B
3,901,291 8/1975 Nogai ..... 139/384 B
3,961,652 6/1976 Aasuda et al. ..... 139/384 B
4,191,220 3/1980 Yoshida ..... 139/384 B

FOREIGN PATENT DOCUMENTS 2707357 8/1978 Fed. Rep. of Germany ... 24/205.16 C

*Primary Examiner*—Henry Jaudon
*Attorney, Agent, or Firm*—Karl F. Ross

[57] ABSTRACT

A slide fastener stringer of the woven type in which the tape has a ground weave provided with warp threads and a weft formed of double-weft passes on a needle loom. The coupling element is of the continuous, preferably coil, monofilament synthetic-resin type in which the two shanks of each coupling member are formed as a double-weft insertion connected in the weaving process with the ground weave of the tape. According to the invention, the warp sheds interwoven the double-weft of the ground weave are separate from the warp yarns interwoven with the double-weft insertions of the monofilament and are spaced or offset therefrom in a direction orthogonal to the slide fastener plane. Some warp yarns are interwoven with the double-weft of the ground weave and run over the shanks of monofilament.

4 Claims, 13 Drawing Figures

WOVEN SLIDE FASTENER STRINGER

FIELD OF THE INVENTION

The present invention relates to a slide fastener and, more particularly, to a slide fastener having a synthetic-resin monofilament coupling element woven into a support tape.

BACKGROUND OF THE INVENTION

Slide fasteners of the woven-tape type generally comprise a pair of tapes which are adapted to be stitched to a garment or other fabric or nonfabric article or otherwise secured thereto, each of the tapes being provided along an edge with a row of coupling heads interdigitatable with the opposing row of coupling heads upon movement of the slide along the rows.

It is known to provide each row of coupling heads unitarily in a synthetic-resin monofilament or strand which is bent to form the coupling heads at respective turns of a coil or meander pattern so that a pair of shanks can extend away from each head and are joined to the shanks of adjacent coupling members (each formed by a head and a pair of shanks) at a respective bend, hereinafter referred to as a bight.

When the coupling element is woven into the respective support tape, which can consist of warp threads interwoven with weft threads lying in a double-weft configuration (i.e. two adjacent weft picks form each weft insertion), the weft threads can be looped around the warp in the region of the coupling element which can form a warp-like strand in the weave from which the heads project laterally along an edge of the tape.

The shanks of the coupling element can form double-weft insertions, when they lie adjacent one another, usually in a superposed configuration with one shank of each member lying directly over the other so that both shanks have a common projection in the slide-fastener plane.

The ground-weave weft threads can run to the regions of the coupling heads and the coupling members can be anchored to the support tape in part by warp threads interwoven with the double-weft insertions formed by the shanks.

While, as noted, the coupling elements can be either of the helical-coil type or the meander type, the preferred configuration for the present purposes is the coil.

A woven slide-fastener stringer half is described in German patent publication-Auslegeschrift DE-AS No. 17 85 363 in which the ground weft threads of the double-weft of the support tape lie adjacent the shanks of the coupling members. In a section orthogonal to the plane of the slide fastener, these ground wefts lie midway between the upper and lower shanks. Hence the shanks of each coupling member are substantially symmetrically disposed to either side of the plane of the tape and project therefrom by at least the thickness of the monofilament and half the height of the eye or loop formed by each coupling member at the respective head.

In this system, the two superposed shanks of each coupling member and the associated double-weft of the ground weft always similarly interwoven with the warp, i.e. are both passed over and under simultaneously by given warp threads. This is a consequence of the nature of the weft insertion by the weft-carrying needle looms used in fabricating these earlier stringers. The term as used herein refers to position during weaving. These "sheds" become yarn passes in the finished article.

While such techniques are effective in the formation of supple tapes from ordinary threads, they are found to pose problems when synthetic-resin coupling elements with thicknesses of 0.4 mm or more are used and which, by comparison with the ground weft threads and with the warp threads are relatively stiff and only limitedly bendable.

The integration of such coupling elements into the support tape has been found to be fraught with problems because of fluctuating and increased mechanical stress which can give rise to variations in the interhead spacing.

Frequently during the normal handling of the stringer, bending can result, i.e. in textile or manufacturing operations or even in use. With systems of the type described, the bending of the finished stringer or slide fastener can result in kinking of the coupling element which may be stressed during weaving and which can create problems when the slide fastener is to be sewn into a garment or the like.

Many of these problems have been traced to the fact that the coupling element is woven in place under the stresses generated by the weaving process so that relative movement of the coupling element and the support tape parts is not possible. When the tension on the tape is relieved, bending and buckling tendencies arise. Furthermore, the resulting slide fastener is not sufficiently flexible and soft for many modern applications and thus has not received wide-spread acceptance.

Greater success has been achieved with constructions of the type described in German patent publication-Auslegeschrift DE-AS No. 20 23 005 in which the double-pick weft insertions of the support tape is formed by ground weft threads while the synthetic-resin monofilament coupling element is formed in situ by coiling the monofilament on a mandrel so that it forms a warp strand which does not constitute any significant part of the weft but is locked in by the ground weft.

This system loses some of the advantages of double-weft insertion and does not utilize fully the possibilities of weft-insertion needle looms. This system also is not capable of truly high speed fabrication.

OBJECTS OF THE INVENTION

It is the principal object of the present invention to provide an improved slide fastener stringer which has a head-to-head spacing and sufficient softness, pliability and flexibility for modern textile-industry applications.

Another object of this invention is to provide an improved woven slide fastener stringer which can more fully utilize modern needle-loom technology with double-weft insertion for both the ground-weave weft and for the weft insertions formed by the shanks of the coupling element.

Yet another object of this invention is to provide an improved method of making a woven slide fastener stringer.

SUMMARY OF THE INVENTION

These objects and others which will become apparent hereinafter are attained, in accordance with the present invention, in a woven slide-fastener stringer half having a ground-weave fabric formed with needle-inserted double-weft threads, i.e. with each weft insertion being a double pick, and with warp threads interwoven with the weft threads to form the support tape, and a synthetic-resin monofilament coupling element whose coupling members each have a head interdigitatable with heads of an opposing coupling element and a pair of shanks running rearwardly from the head and interwoven with the ground weave pair of shanks constitutes a weft insertion in the dorm of a double pick, the shanks of each member being connected to adjacent members at respective bights remote from the heads.

According to the invention the double-pick weft insertion of the ground-weave weft thread, on the one hand, and double-pick weft insertion of the monifilament on the other hand are interwoven with separate warp ends offset in a direction orthogonal to the slide fastener plane.

In one embodiment of the invention, which can be fabricated with especially high speeds and is very pliable and soft, each double-pick weft insertion or at least every other or every third double-pick weft insertion of the ground weave is disposed below the coupling element and interwoven with respective ground-weave warp ends, with at least some of these warp ends passing out of the slide-fastener plane, the over shanks of the coupling element and forming all or part of respective warp ends binding the coupling element into the ground weave.

The reference to "below the coupling element" is intended to indicate any location below the level of the coupling element of a coupling member thereof, i.e. directly therebeneath or laterally shifted from a location directly below a coupling member to a location between two coupling members or even beneath an adjacent coupling member. In a slide-fastener stringer according to the invention, therefore, the double-pick ground-weave weft insertions and the monofilament shank double-pick weft insertion of the respective coupling elements lie in separate warp sheds which are located one above one another orthogonal to the slide-fastener plane with the connection ensured by the fast that at least several, usually many, warp threads pass from the ground weave over the double-pick weft insertions formed by the shanks of the monofilament into the warp pockets individual thereto.

The slide fastener has been found to be especially soft and flexible, apparently because the weft threads of the support tape and the tape itself permit such movements of the coupling members, even upon bending of the stringer out of the slide fastener plane, that detrimental stresses do not arise. However, the connection between the coupling element and the tape affords extremely stable interhead spacings which are maintained even upon washing, dyeing and ironing of the products in which the slide fastener is incorporated. This applies as to fine coupling elements as well as to thick monofilaments. Thus the thickness of the monofilament can be selected over a wide range with respect to the thickness and strength of the textile tape.

In a preferred embodiment of the invention, which constitutes the best mode providing high fabrication speed and optimum characteristics, between the double-pick weft insertions of the ground weave (which lie under the coupling members) an intermediate double-pick weft insertion of the ground weave is disposed approximately midway between neighboring coupling members.

Each two double-pick weft insertion of the ground weave are interwoven in common by respective warp ends while each double-pick weft insertion of the monofilament shanks is interwoven with respective warp ends offset in the longitudinal direction of the slide fastener and passing over two monofilament double-pick weft insertion. Thus each of these latter threads passes alternately over two monofilament double-pick weft insertion and under the next two monofilament double-pick weft insertion. Others of these threads pass over and under pairs of monofilament double-pick weft insertion including one monofilament double-pick weft insertions of each of the first mentioned pairs.

Modifications of this arrangement can have groups of three or more ground-weave double-pick weft insertion and groups of three or more interwoven in common with respective warp ends. Conversely, each upper and lower warp pocket can receive only a single double-pick weft insertion and the systems can be combined so that the ground weave double-pick weft insertion and the monofilament double-pick weft insertions are in different numbers within the respective warp pockets.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
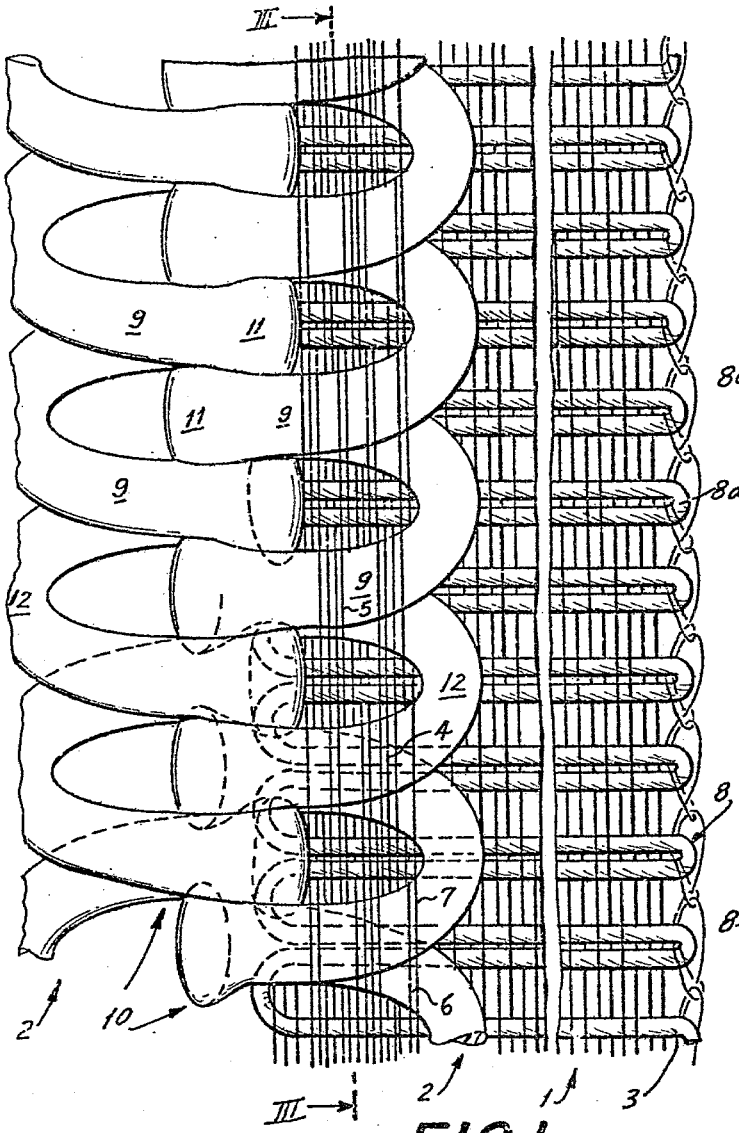
FIG. 1 is a diagrammatic plan view of one stringer half of a slide-fastener stringer embodying the invention and of which only the coupling element of the other stringer half has been illustrated.

Throughout this description, corresponding reference numerals will be used to designate identical or identically functioning structures. Reference numerals in respective hundreds series have been used to indicate similarly functioning elements where major structural differences exist. Throughout the weft and warp threads are shown by double line or single line illustration, as may be desirable for effective understanding of the invention, and frequently threads are shaded or shown with different textures to enable them to be distinguished from other threads in a particular group.

FIGS. 1 through 6 show a woven slide fastener stringer in which the support tape 1 is woven from weft and warp yarns and into which the continuous coupling element 2 of a synthetic resin monofilament, has been woven.

Figure 3:
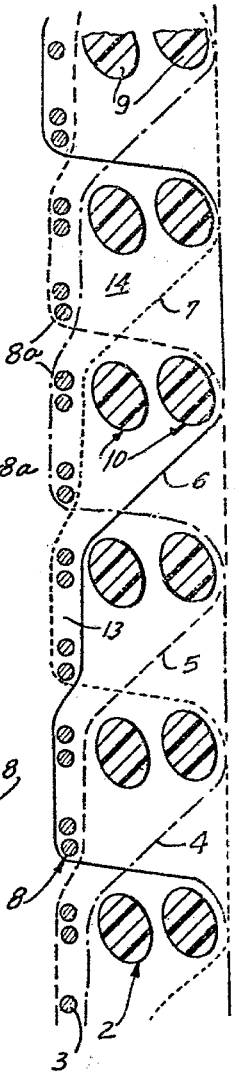
FIG. 3 is a cross-sectional view taken along the line III—III of FIG. 1.
Figure 2:
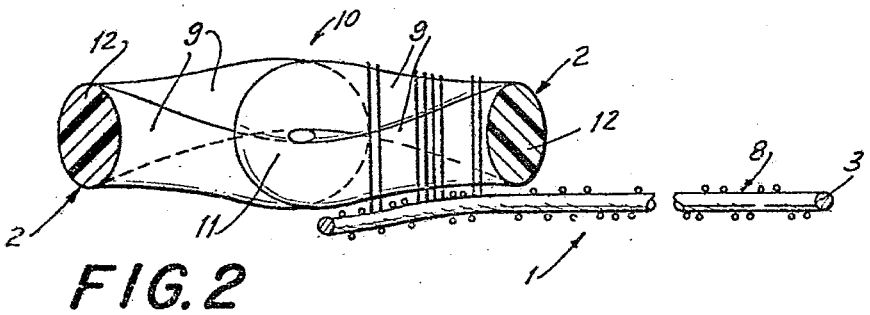
FIG. 2 is a view in section taken in the direction of arrow II of FIG. 1.

For convenience of illustration, the weft threads 3 of the support tape 1 are shown disproportionately thick while the warp threads 4, 5, 6 and 7 are represented proportionately thinner than reality, namely, as single lines. In practice, both the warp and weft threads of the fabric can have the same or only slightly different thickness. In FIG. 3, moreover, only four representative warp ends have been shown since their patterns are repeated by the other warp ends securing the coupling element of FIGS. 1 and 2.

In the illustration of FIGS. 3 through 6, warp threads involved in different patterns have also been represented diagrammatically by broken dot-dash or dotted lines for convenience.

As will be apparent from FIGS. 1 through 6, the support tape 1 is constituted by the warp threads 4, 5, 6, 7 and double-pick weft insertions 8 of the weft thread or yarn 3. Double-pick weft insertions are wefts formed by a forward and back pass of the weft yarn adjacent one another and received in the same warp pockets, i.e. are overpassed and underpassed in the same warp pattern across the width of the tape.

The continuous coupling element 2 is in the form of a coil with the shanks of the synthetic resin monofilament likewise forming double-pick weft insertions, i.e. both shanks 9 of each coupling member overpassed and underpassed in common by the warp ends. In the embodiment illustrated the shanks 9 extend rearwardly from a coupling head 11 formed as a loop or eye and are interdigitatable, as illustrated in FIG. 1, between the coupling heads of the opposing coupling elements.

Each coupling head 11 and the associated shanks 9 form a respective coupling member, generally designated at 10, which is connected to the adjacent coupling members by bights 12.

Customarily two stringer halves as shown in FIG. 1 have their coupling elements interdigitable upon movement of a slider along the stringer formed by the two halves and constituting the slide fastener therewith.

The shanks 9 of each coupling member 10 are so arranged that one lies above the other and the two shanks have a common projection, between the head and the respective bights, in the slide fastener plane.

The ground weft thread 3 is, therefore, formed into the two double-pick weft insertions 8 which reach across the entire tape to the region of the coupling heads 11 of the coupling members 10, these coupling heads projecting beyond the edge of the tape.

The coupling members are held in place by being interlaced with the connective warp yarns 4, 5, 6 and 7 which pass over the shanks of the coupling members and anchor the coupling element at the support tape 1.

In all of the embodiments of FIGS. 1 through 6, each two double wefts 8, i.e. the double-pick weft insertions in pairs, are received interlaced in common by the warp at 13 below the coupling element 10. The warp pockets 13 are in part formed by the warp threads 4,5, 6, 7 which extend out of the slide fastener plane and over the respective shanks 9 of the coupling members 10 in the manner previously described.

The warp pockets 14, i.e. the connective sheds, are formed by the warp threads 4–7 above the tape plane and can be of various constructions as a comparison of FIGS. 3 through 6 will show. The shanks of a coupling member and the double-pick weft insertions of the tape underlying same are interlaced with different groups of warp yarns and hence are in different pockets offset from one another in a direction orthogonal to the plane of the tape.

This construction affords all of the advantages previously asserted since the weft 3 and the coupling element 2 can move relatively under bending and buckling stresses in the slide fastener plane or out of the slide fastener plane without allowing the interhead spacing to be modified significantly. However, since the number of anchoring warp yarns 4–7, the thickness thereof and the tension of these warp yarns can be selected as desired, the stability of the stringer is ensured and the pliability and softness can be selected accordingly.

Between the double-pick weft insertions 8 of the ground-weave weft yarn 3, which lie below the coupling members 10, there are formed double-pick weft insertions 8*a* of the ground weave approximately centrally between the adjacent members 10.

In the embodiment of FIG. 3, therefore, each pair of double-pick weft insertions 8, 8*a* are located in a respective pocket 13 while each pair of shanks are received in a pocket 14 whose warp yarns 4, 5, 6, 7 each span two adjacent coupling members 10.

Figure 5:
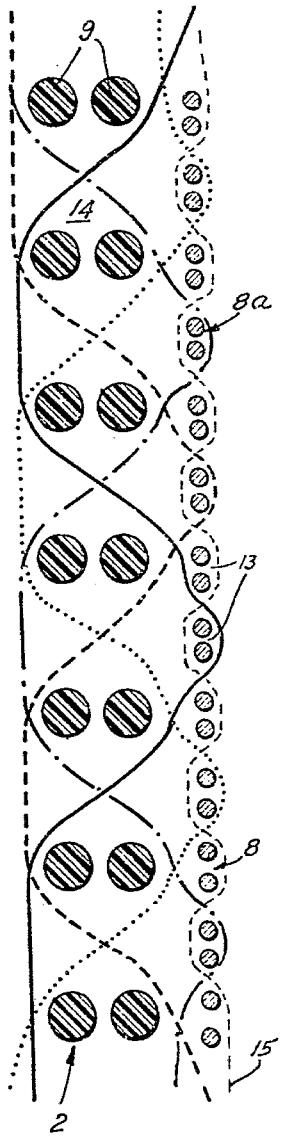
FIGS. 5 and 6 are views similar to FIG. 3 but illustrating other embodiments in diagrammatic form.
Figure 6:
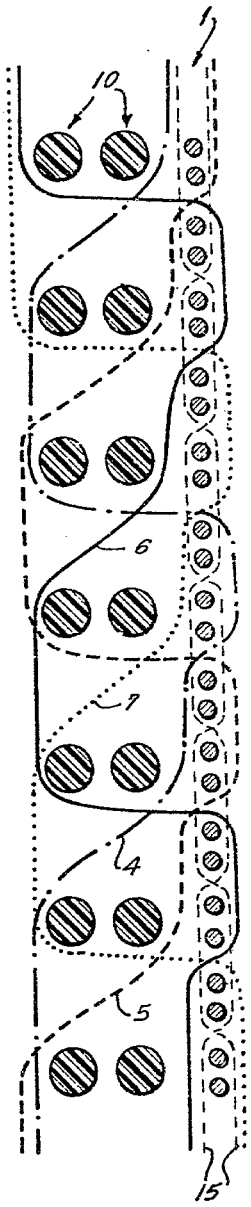

As can be seen in FIGS. 5 and 6, some of the warp threads 15 can pass individually over and under each double-pick weft insertion of the ground fabric to form individual shed therefor (FIG. 5) or over pairs of double-pick weft insertions (FIG. 6), these warp threads 15 lying only in the plane of the tape.

In the embodiment of FIG. 3, each warp thread 4–7, after spanning two double-pick weft insertions of the coupling element, forms a pocket 13 for two double-pick weft insertions of the fabric tape.

Figure 4:
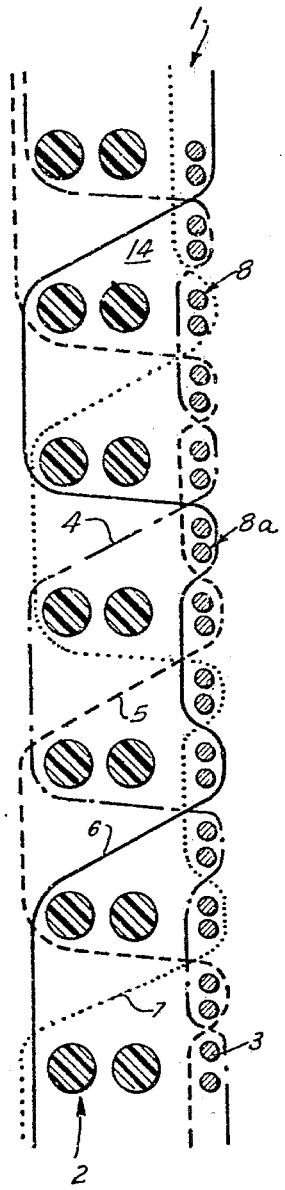
FIG. 4 is a view similar to FIG. 3 of another embodiment of the invention in which the coupling-element double-pick weft insertion and the ground-weave double-pick weft insertion underlying same are interlaced with warp ends in different patterns.

In FIG. 4, however, each of the yarns 4–7 forms a pocket 14 for two double-pick weft insertion of the coupling element and then a pocket for a double-pick weft insertion of the fabric, followed by a pocket for two double-pick weft insertions.

In all of the embodiments of FIGS. 3 through 6, the warp threads 4–7 are staggered in their patterns.

FIGS. 5 and 6 have been found to form especially soft and flexible stringers with good characteristics when subjected to bending or buckling stesses because each of the threads 4–7, after forming the pocket 14, is then interlaced with at least one and preferably two double-pick weft insertions of the tape.

Figure 7:
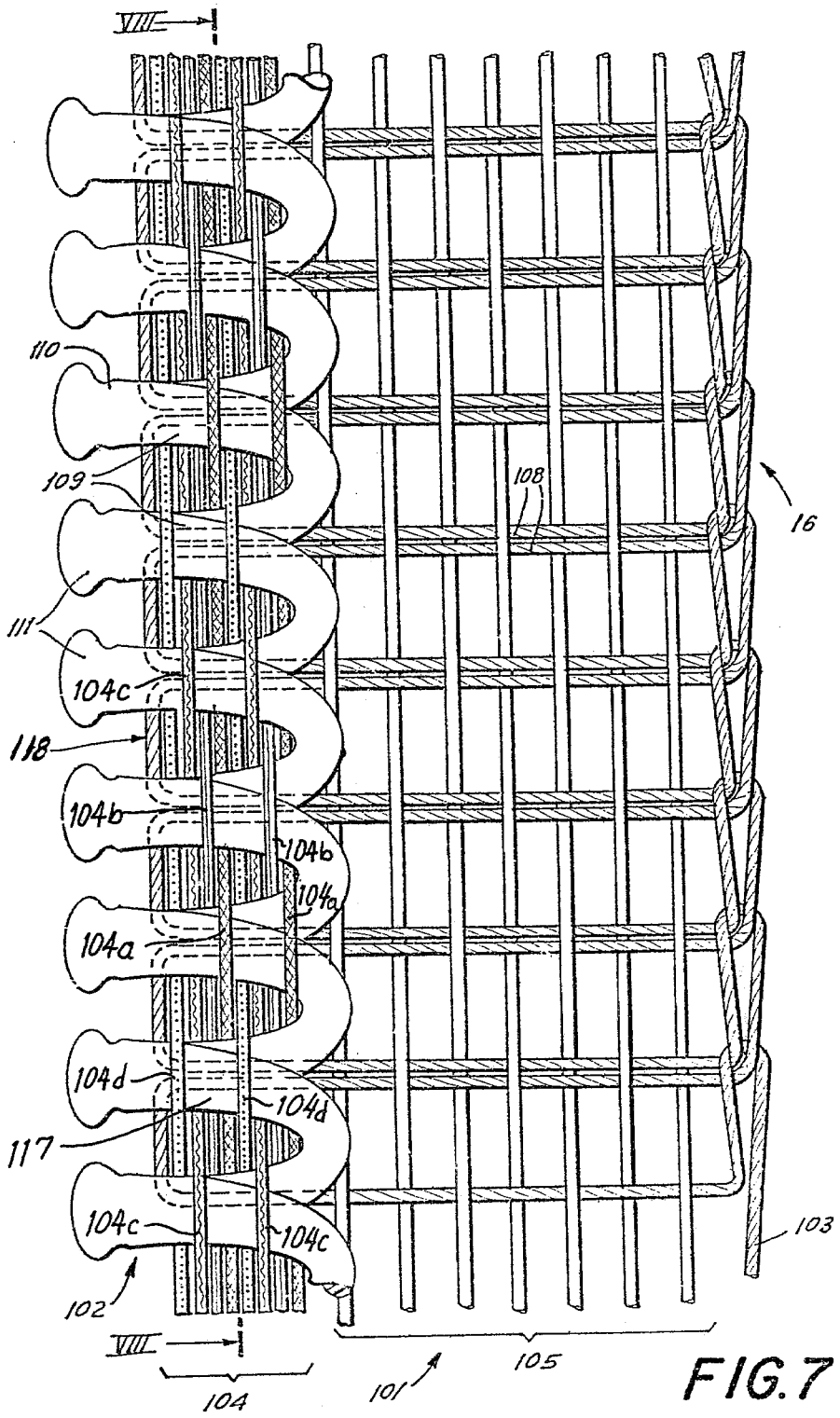
FIG. 7 is a plan view similar to FIG. 1 but illustrating a slide-fastener stringer half according to yet another embodiment of the invention.
Figure 8:
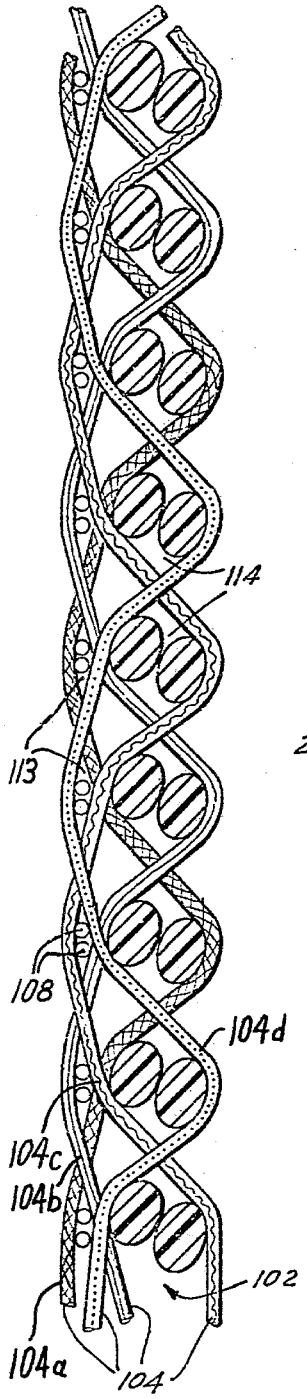
FIG. 8 is a cross-sectional view taken along line VIII—VIII of FIG. 7.

In the embodiment of FIGS. 7 and 8, the woven tape 101 has a coupling element 102 incorporated therein by weaving and engaged by the warp yarns 104 (individually shown at 104*a*, 104*b*, 104*c*, 104*d*). The warp yarns 105 form part of the ground weave of the tape which has, as described, a weft yarn 103 which, at the edge remote from the coupling element, is looped to form the knitted edge 16.

Here as well the coupling heads 111 of the coupling members 110 project beyond the edge 118 of the tape. The shanks 109 of the coupling members 110 are superposed as described so that they have a common projection on the slide fastener plane, the shanks being interconnected by the bights 112.

The ground weave weft 3 is in the form of the double-pick weft insertions 108 which extend over the full width of the tape, one double weft 108 being provided for each coupling member 110.

The shanks of the coupling members 110 are provided as double-pick weft insertions 117.

As can be seen from FIGS. 7 and 8, the double-pick weft insertions 108 and 117 of the stringer half are received in respective pockets 113, 114 which are offset from one another although the pockets are separate in a direction orthogonal to the slide fastener plane. Thus each of the warp threads 4 has a high-middle-low-middle repeating pattern in which, at "high" position the warp thread passes over the monofilament double-pick weft insertion 117. In each "middle" position, the warp thread passes between a monofilament double-pick weft insertion 117 and the underlying double weft 108 while in the "low" position the warp passes under a double-pick weft insertion 117 of an adjoining coupling member. The relationship from one warp yarn 104*a* to the next (104*b*, 104*c*, 104*d*) is offset so that each warp yarn can pass beneath, say, three coupling members and when eight warp yarns 104 are used, as is preferred, each fourth warp yarn passes over a given coupling member.

Figure 9:
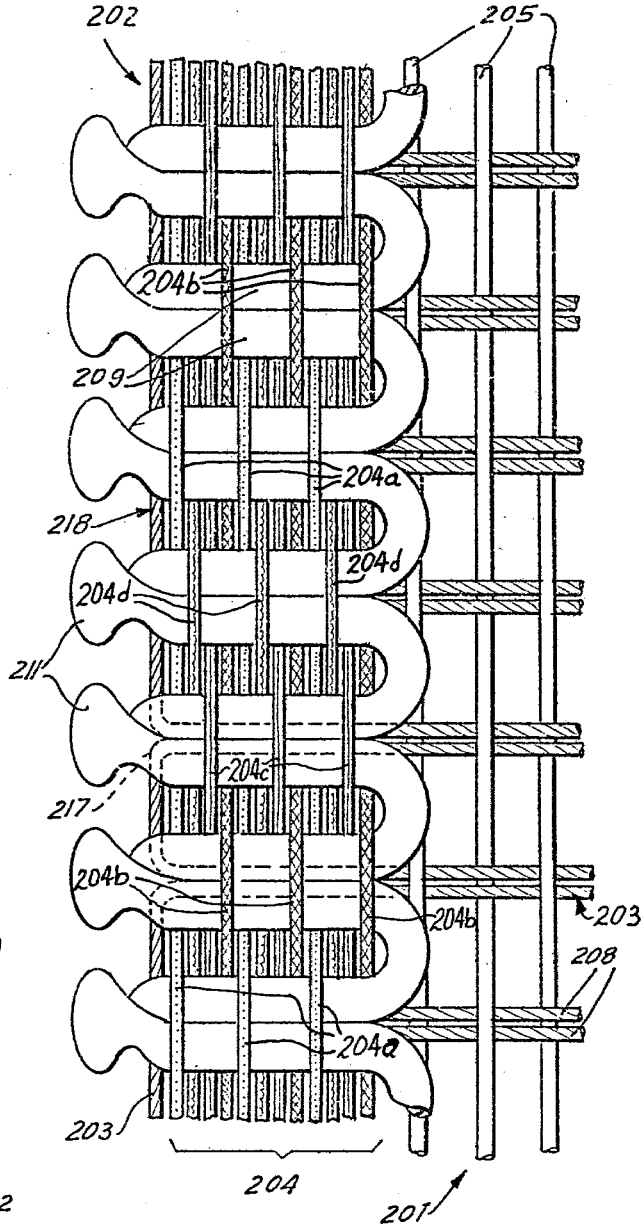
FIG. 9 is a fragmentary view similar to that of FIG. 7 but illustrating another embodiment.

The embodiment of FIG. 9 differs from that of FIGS. 7 and 8 in that the double-pick weft insertions 217 formed by each pair of shanks 209 of a given coupling head 211 lie substantially side by side and the shanks are longer than those of the FIGS. 7 and 8 embodiment so that a greater number of connective warp threads 204 can be provided. The edge 218, as in the case of FIG. 9, is formed by the weft yarn 203 whose double-pick weft insertions 208 are interwoven with the warp yarns 205 over the balance of the tape. This modified coupling element 202 can also be used in the FIG. 1 embodiment. Preferably twelve warp threads 204*a*–204*d*, in an appropriate repeat, are used to anchor the coupling element 202 in place.

The embodiment shown in FIGS. 10 through 12 comprises a ground-weave tape 301 and a coupling element 302 substantially of the coil type, the tape 301 having warp yarns 306 and warp threads 304, 305 as will be described hereinafter. The tape also has a ground-weft yarn 303 in double-pick weft insertions 308 and a knitted edge 316 remote from the coupling edge 318 beyond which the coupling heads 311 project. As previously described, the coupling heads 310 have shanks 309 which form double-pick weft insertions 317 and are interconnected by the bights 312. The shanks 309, at least over most of the lengths, can be in contact with one another (FIG. 11) so that they have practically common projections in the slide fastener plane and support one another against relative displacement.

In the embodiment illustrated, one double-pick weft insertion 308 is provided for each coupling member 310 and hence double-pick weft insertion 317 and underlies each such double-pick weft insertion 317.

The warp threads 304, 305 engage the double wefts 308 and 317 in respective warp pockets 313 and 314 such that each tape double weft is received in a pocket of a respective warp thread 304*a*–304*d*, 305*a*–305*d* different from that in which the overlying monofilament double weft 317 is received. The pockets 313, 314 formed by the warp threads 304, 305 are thus different from one another orthogonally to the slide fastener plane.

The eight rearward threads 304*a*–304*d* in a repeat are disposed in a high-high-middle-low repeating pattern in which they pass over two coupling members, between a coupling member and the underlying double-pick weft insertion 308 and below the next double weft 308 before the pattern is repeated.

The warp threads 305, however, have a high-middle-low-middle repetitive pattern in the manner described. The patterns of the successive warp threads 304, 305 are staggered (FIG. 10) although they lie practically in laterally contacting relationship one against the other. The warp yarns 306 form the common high-low pattern.

Figure 10:
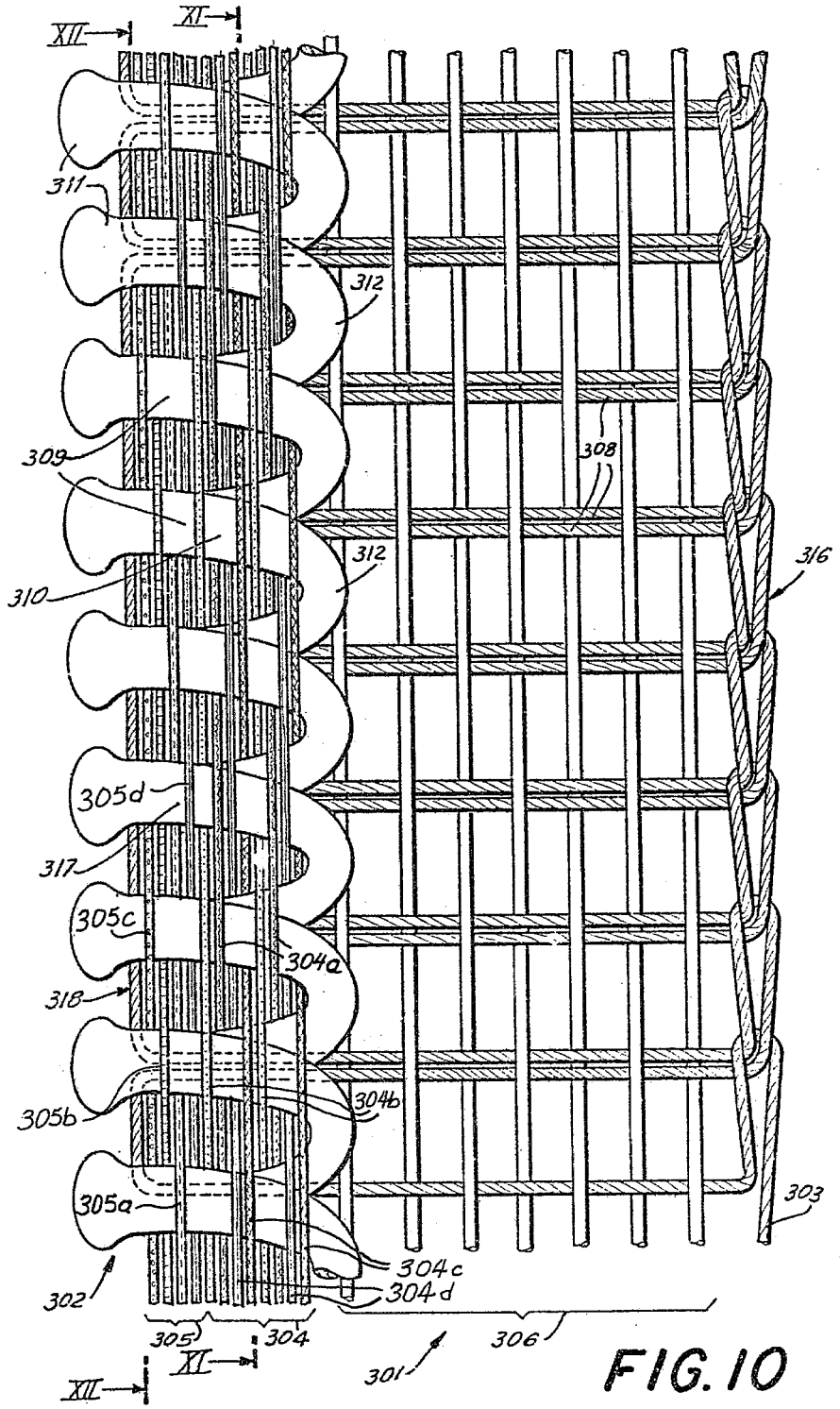
FIG. 10 is a plan view of an embodiment which constitutes a variant of the FIG. 7 structure.
Figure 12:
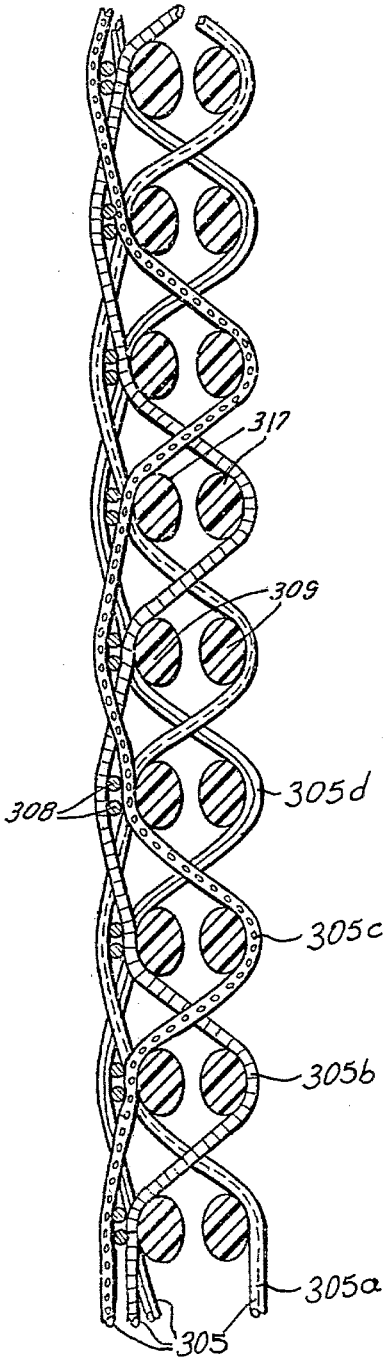
FIG. 12 is a longitudinal section along the line XII—XII of FIG. 10.
Figure 11:
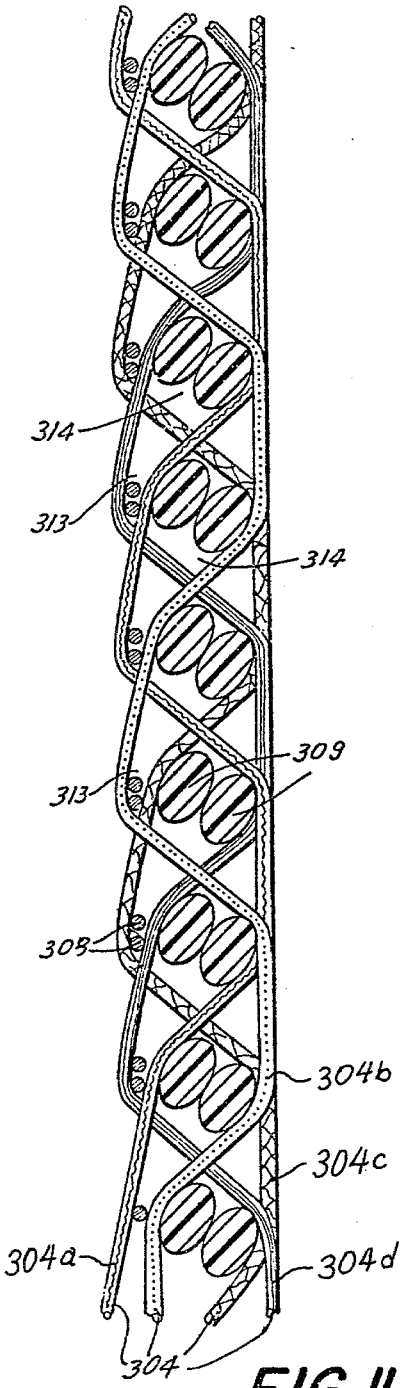
FIG. 11 is a longitudinal section along the line XI—XI of FIG. 10.
Figure 13:
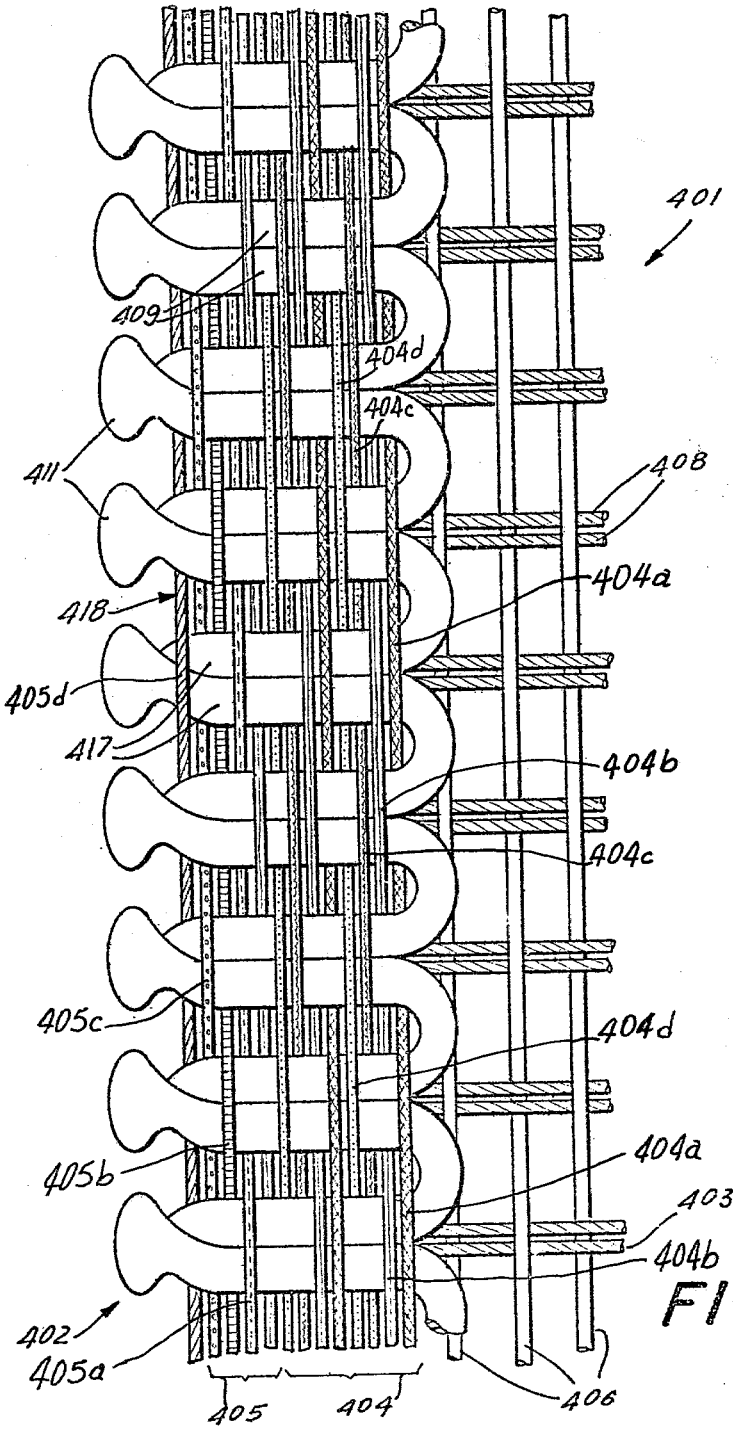
FIG. 13 is a fragmentary illustration of a modification of the system of FIG. 10 and also shown as a diagrammatic plan view of one stringer half.

In FIG. 13, we have shown an embodiment which is similar to that of FIGS. 10 through 12 wherein, however, the double-pick weft insertions 417 of the monofilament coupling element 402 are somewhat longer and lie adjacent one another rather than one above the other as in the embodiment of FIG. 10. The tape 401, the double-pick weft insertion 408 of the tape, the ground weft 403, the warp yarns 406 and the warp threads 404 (404*a*–404*d*, 405 (405*a*–405*d*) all cooperate in the manner previously described to form the stringer with its coupling edge 418 beyond which the heads 411 project. The shanks 409 can also be clearly seen.

We claim:

1. A slide-fastener stringer half comprising a woven tape and a continuous monofilament coupling element interwoven with said tape, said tape being formed with a ground weft comprised of a plurality of double-pick weft insertions extending transversely of said tape and interlaced with warp yarns, said coupling element being formed of double-pick weft insertions and is provided with a multiplicity of coupling members each having a head overhanging an edge of said tape and a pair of shanks extending inwardly from said edge, said warp yarns including connective warp threads interlaced with the double-pick weft insertions of said ground weft and with the double-pick weft insertions of said coupling element inwardly of said edge of said tape such that the warp threads pass over and under said double-pick weft insertions in a staggered pattern and each of said warp threads passes in succession over a double-pick weft insertion of said coupling element, under two successive double-pick weft insertions of the ground weft, and between the next two double-pick weft insertions of the ground weft and a double-pick weft insertion of said coupling element before entering a pattern repeat, a respective double-pick weft insertion underlying each double-pick weft insertion of said coupling element, and a further double-pick weft insertion of said ground weft being disposed between successive double-pick weft insertions of said coupling element.

2. A slide fastener stringer half comprising a woven tape and a continuous monofilament coupling element interwoven with said tape, said tape being formed with a ground weft comprised of a plurality of double-pick weft insertions extending transversely of said tape and interlaced with warp yarns, said coupling element being formed of double-pick weft insertions and is provided with a multiplicity of coupling members each having a head overhanging an edge of said tape and a pair of shanks extending inwardly from said edge, said warp yarns including connective warp threads interlaced with the double-pick weft insertions of said ground weft and with the double-pick weft insertions of said coupling element inwardly of said edge of said tape such that the warp threads pass over and under said double-pick weft insertions in a staggered pattern with each of said warp threads passing in succession over two double-pick weft insertions of said coupling element, under a double-pick weft insertion of the ground weft beneath the next double-pick weft insertion of said coupling element, between the next two double-pick weft insertions of the ground weft and the next double-pick weft insertion of the coupling element, and beneath the next double-pick weft insertion of the ground weft before entering a pattern repeat, a respective double-pick weft insertion underlying each double-pick weft insertion of said coupling element, and a further double-pick weft insertion of said ground weft being disposed between successive double-pick weft insertions of said coupling element.

3. A slide-fastener stringer half comprising a woven tape and a continuous monofilament coupling element interwoven with said tape, said tape being formed with a ground weft comprised of a plurality of double-pick weft insertions extending transversely of said tape and interlaced with warp yarns, said coupling element being formed of double-pick weft insertions and is provided with a multiplicity of coupling members each having a head overhanging an edge of said tape and a pair of shanks extending inwardly from said edge, said warp yarns including connective warp threads interlaced with the double-pick weft insertions of said ground weft and with the double-pick weft insertions of said coupling element inwardly of said edge of said tape such that the warp threads pass over and under said double-pick weft insertions in a staggered pattern, each warp thread passing over two double-pick weft insertions of said coupling element, between the next double-pick weft insertion of said coupling element and an underlying double-pick weft insertion of said ground weft, below the next double-pick weft insertion of the ground weft, and between the next double-pick weft insertion of the ground weft and an overlying double-pick weft insertion of said coupling element before entering a pattern repeat, a respective double-pick weft insertion of said coupling element, and a further double-pick weft insertion of said ground weft being disposed between successive double-pick weft insertions of said coupling element.

4. A slide-fastener stringer half comprising a woven tape and a continuous monofilament coupling element interwoven with said tape, said tape being formed with a ground weft comprised of a plurality of double-pick weft insertions extending transversely of said tape and interlaced with warp yarns, said coupling element being formed of double-pick weft insertions and is provided with a multiplicity of coupling members each having a head overhanging an edge of said tape and a pair of shanks extending inwardly from said edge, said warp yarns including connective warp threads interlaced with the double-pick weft insertions of said ground weft and with the double-pick weft insertions of said coupling element inwardly of said edge of said tape such that the warp threads pass over and under said double-pick weft insertions in a staggered pattern, each warp thread passing in succession over two double-pick weft insertions of said coupling element, between the next double-pick weft insertion of the coupling element and an underlying double-pick weft insertion of the ground weft, over the next double-pick weft insertion of the ground weft, under the next two double-pick weft insertions of the ground before entering a pattern repeat, a respective double-pick weft insertion of said ground weft being disposed between successive double-pick weft insertion of said ground weft being disposed between successive double-pick weft insertions of said coupling element.

* * * * *